United States Patent [19]

Flatau et al.

[11] 3,982,489

[45] Sept. 28, 1976

[54] KINETIC ENERGY RING PROJECTILE

[76] Inventors: Abraham Flatau, 2003 Stockton Road, Joppa, Md. 21085; Donald N. Olson, 38 Atherton Road, Lutherville, Md. 21093; Miles C. Miller, 504 Haverhill Road, Joppa, Md. 21085

[22] Filed: Nov. 29, 1972

[21] Appl. No.: 310,625

[52] U.S. Cl. ..... 102/92.4; 102/92.1; 102/92.6

[51] Int. Cl.[2] ..... F42B 11/36; F42B 13/00

[58] Field of Search ..... 102/92.1, 41, 43 P, 102/64, 92.6, 92.7, 92.4, 92.3, 92.2; 46/74 R

[56] References Cited

UNITED STATES PATENTS

| | | | |
|---|---|---|---|
| 1,204,282 | 11/1916 | Lake | 102/92.1 X |
| 3,264,776 | 8/1966 | Morrow | 46/74 R |
| 3,732,821 | 5/1973 | Royer | 102/41 |
| 3,732,826 | 5/1973 | Johnson | 102/43 P |

FOREIGN PATENTS OR APPLICATIONS

| | | | |
|---|---|---|---|
| 1,054,077 | 1/1967 | United Kingdom | 102/64 |

*Primary Examiner*—Charles T. Jordan
*Attorney, Agent, or Firm*—Nathan Edelberg; Robert W. Church

[57] ABSTRACT

A rotatable airfoil non-lethal sting projectile comprising a hollow closed circular ring wing surrounding a central open area. The projectile consists of an aerodynamic lifting body of a thick ring wing geometry which uses spin imparted to it from a launching means for its gyroscopic stability. The combination of aerodynamic stability characteristics and high spin rate (i.e. above 2,000 rpm) results in a flat trajectory and extended range capability.

The projectile is intended as a riot control weapon. Impact is non-lethal, but may be painful. The subsonic launch velocity, the non-metallic light weight structure, the soft resilience, and relatively large size of the projectile avoids serious bodily harm due to impact with a person even at point-blank range.

7 Claims, 7 Drawing Figures

KINETIC ENERGY RING PROJECTILE

DEDICATORY CLAUSE

The invention described herein may be manufactured, used or licensed by or for the government for governmental purposes without payment to us of any royalty thereon.

Briefly stated, the present invention relates to a nonlethal ring air foil projectile adapted for use in pacifying or dispersing unruly persons such as, for example, mobs.

The wide spread mob violence of recent years has spurred the development of numerous mob control devices including, notably rubber bullets fired from a flare pistol and other types of projectiles and also various hand-held weapons for use by military and civil police to control mob violence. Desirably the authorities should be equipped with projectile means to disperse or control mobs without killing, disfiguring or permanently injuring any member thereof.

Unfortunately, the mob control devices of a projectile nature proposed heretofore suffer from certain serious disadvantages. If fired from too close, e.g. point blank, the projectile can cause serious injury to a target individual. On the other hand, the accuracy of the usual mob control projectile, as for example a tear gas grenade, is not very accurate when fired from a distance great enough for the policeman to be out of range of injurious objects such as rocks which might be hurled by rioters.

It has now been discovered that the ring air foil munition disclosed in copending application of A. Flatau, Ser. No. 272,252, filed July 17, 1972, issued as U.S. Pat. No. 3,877,383 on Apr. 15, 1975, which in turn is a C.I.P. of Ser. No. 105,751, filed January, 1971, now abandoned, is well adapted to mob control, particularly if modified into the structure of the present invention.

The munition projectile comprises a ring air foil or ring wing, i.e. a body of revolution generated by an air cross-section rotated 360° about an axis beneath and parallel to the longitudinal direction of the airfoil cross-section. The hollow region internally of the ring wing houses the payload and explosive train. In particular, the munition projectile of the aforementioned copending application comprises an aerodynamic lifting body of a thick ring wing geometry which utilizes a spin in excess of about 2,000 rpm imparted thereto by the launching means for gyroscopic stability. Normally this projectile has a near neutral static stability and associated aerodynamic performance characteristics which provide predictable repeatable relatively flat trajectories and extended range. These aerodynamic characteristics are based on the generation of a lift force, as gravity tends to pull the projectile downward, and the low drag shaping. To provide for payload capacity, the wing cross-section should exceed 25% of the chordal dimensions.

Important to use of a ring air foil projectile for mob control purposes is its relatively low launching velocity, being always launched at a subsonic velocity e.g. below about 300 ft/sec. Low launch velocity and an extended range are desired attributes for a mob control device which will not cause lethal injury on impact with of the human body at point blank range yet be effective from a distance far enough to be out of the rock-throwing range of rioters e.g. 100 meters.

The principal object of the present invention is to provide a projectile which will not cause lethal injury upon impact with the human body even at the point-blank range.

Still other objects of the invention and the advantages of the invention will become apparent from the detailed description thereof hereinafter set forth.

Briefly stated, the ring air foil projectile of the present invention is a relatively thick non-frangible ring wing light in weight, normally formed from non-metallic materials. The materials and structure, including size, of the ring air foil are such that the ring air foil constitutes a projectile which can bruise a target individual, but not cause lethal injuries at sub-sonic impact velocities.

Important to the sting concepts involved with practice of this invention is the considerable accuracy of the projectile. Its near neutral static stability and associated aerodynamic performance characteristics at high spin provide repeatable relatively flat trajectories. At 30 meters, the projectile can be fired from a rifle adapter so as to hit the torso or lower limbs of a target person.

For a more detailed description of this invention and disclosure of preferred embodiments thereof, reference is now made to the attached drawings wherein.

Figure 1:
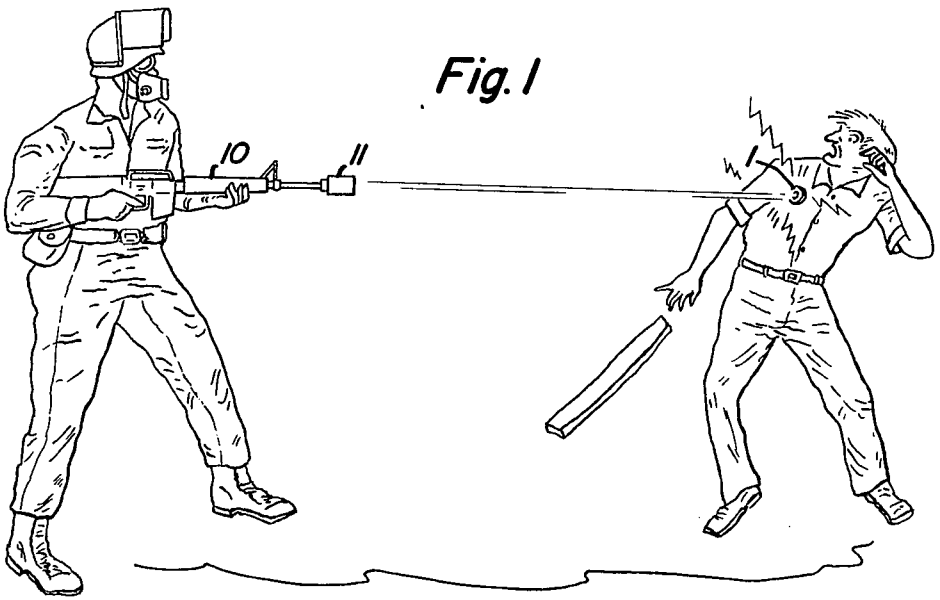
FIG. 1 is a diagrammatic view showing the sting character of the ring air foil projectile.

As shown in FIG. 1, the ring air foil 1 is adapted to sting upon impact, intimidating individuals and hopefully dispersing mobs. The ring air foil 1 is a ring wing with an inner wall 2 and an outer wall 3 joined at leading edge 4 and trailing edge 5 with the payload space or annular hollow portion 6 between walls available for weight adjustment purposes, e.g. left empty, foam filled, etc. Walls 2,3 are, of course, contoured to be airfoil shapes and together have a thickness to chord ratio ration in excess of 20%. Projectile 1 can be molded entirely of foam plastic not requiring walls.

Since a principal object of the present invention is to provide a nonlethal launched (rather than thrown or hurled) projectile, the material used for the ring air foil should be particularly light weight, even soft and plastic such as rubber, polyethylene, polypropylene, etc. Soft plastics are known to the art and therefore the actual materials from which projectile 1 is fabricated form no part of the present invention. In addition, use of thick wall sections and no fill for space or annular hollow portion 6, or thin wall sections supported by foamed resin in space or annular hollow portion 6 are too well known for detailed discussion thereon. Indeed resin foaming techniques are adapted to forming projectile 1, as for example molding projectile 1 to shape in the presence of a blowing agent under circumstances when a thick essentially pore-free skin (i.e. walls 2,3) is formed along with a low density resin foam interior 7. In this construction, provision can be made to insert ballast of denser soft plastic 8 for CG control and the tailoring of the manner in which the impact energy is transferred to the target.

Figure 3:
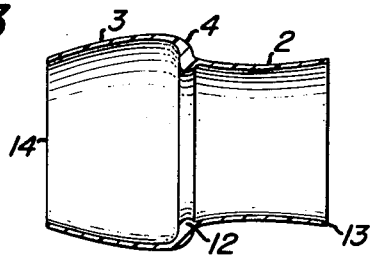
FIG. 3 is a view of a preferred mode of projectile showing the projectile body with the inner wall extended.

Illustrated by the drawing is a preferred construction of the ring air foil projectile wherein the walls 2,3 and leading edge 4 are initially an integral envelope member (shown in FIG. 3).

Figure 2:
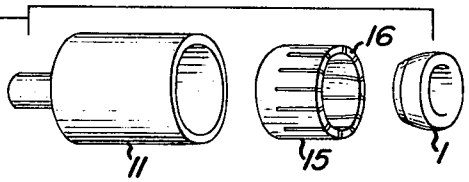
FIG. 2 is an exploded view showing a weapon adapter to eject the projectile from the weapon, a sabot and the projectile.

It may be noted that mechanical launch means such as a rifle 10 and adapter 11 (FIGS. 1 and 2) are capable of imparting spin in excess of 2,000 rpm, normally 4,000–6,000 rpm, and a high but sub-sonic launch velocity. Many lightweight plastic materials suitable for the ring wing material are strong enough for safe handling, even mishandling without rupture as well as to withstand the ultimate impact on a target without fragmenting. Also in the event any ring air foil projectile is hurled back by a rioter, its light weight makes it a harmless hand-hurled missile.

The importance of non-lethality makes the preferred size range for the non-lethal air foil of the present invention surprisingly narrow, i.e. 2–3 inch diameter. The minimum size projectile should be too large to impact principally in someone's eye, yet the largest projectile should be small enough and light enough so that its impact energy will not crush the face.

A desirable attribute of the non-lethal ring air foil projectile of the present invention is that accuracy and a relatively extended range are combined with the relatively low launch velocity of below about 300 ft/sec., preferably 200–300 ft/sec. The ring air foil projectile 1 launched from a rifle mounted adapter 11 (see FIG. 2) is accurate to about 100 meters (or yards). The spin due to the launch imparts gyroscopic stability. The launch means imparts the stinging velocity. The low aerodynamic drag and the low spin damping characteristics inherent in the shape conserves both angular momentum and velocity, providing an extended relatively flat trajectory, which is advantageous. The kinetic energy derived from the launch means is imparted, or transmitted, to the target at impact.

Figure 4:
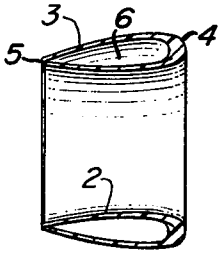
FIG. 4 is a fragmentary view of the projectile.
Figure 7:
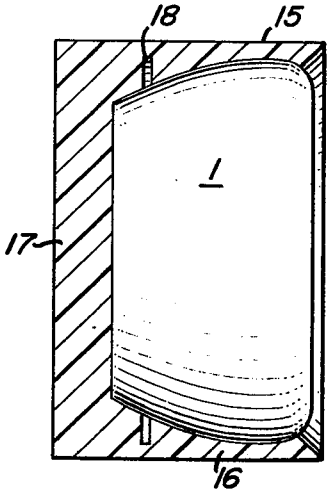
FIG. 7 is a view showing the projectile mounted in the sabot for ejection from a weapon.

In the embodiment illustrated in FIGS. 3 and 4 of the drawing, the ring air foil 1 is an envelope type container fabricated of a soft and resilient material such as soft rubber or a non-brittle resin. Inner wall 2 is formed (e.g. molded) integral with outer wall 3, the walls being joined by shoulder 12. Inner wall 2 can be folded inward to nest within outer wall 3, with the edge 13 of inner wall 2, being heat sealable in conventional manner to the edge 14 of outer wall 3 to form a trailing edge 5, which may be done after a strengthening or weighting substance is loaded between inner wall 2 and outer wall 3. The outer exposed or exterior surface of outer wall 3 and the exposed exterior surface of inner wall 2 define the major surfaces and the diametric extent of the structure or projectile 1 as illustrated in FIG. 3 for example. So also, the leading edge 4 and the trailing edge 5 of projectile 1 define the longitudinal extent thereof.

Figure 5:
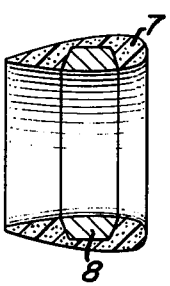
FIG. 5 is a fragmentary view of an alternate construction of the projectile using a blowing agent to form a low density foam interior and a thin pore-free skin in one operation.

In the mode of FIG. 5, projectile 1 is molded of foam 7 in one operation where a thin, pore-free skin results from conventional molding techniques, and provision can be made for including a non-foamed ballast 8 of a denser rubber-like material. The shape, location and density of the ballast can be varied to meet the desired conditions. The density of the foam can also be varied in keeping the desired characteristics of mass and density distribution for tailoring the aerodynamic and impact properties.

The ring air foil projectile structures illustrated in the drawing is a modified Clark-Y air foil. The ring wing is thick, made so by blending two air foils having different thickness to chord ratios in back-to-back relationship. Their respective thickness to chord ratios is nominally 22% and 11% of the resultant ring air foil having a thickness to chord ratio of 28.5%. However, other back-to-back air foil cross-sections are contemplated as being within the scope of this invention so long as such other ring wings have a combined nominal thickness to chord cross-section ratio of at least about 20%.

The thick ring wing (e.g. the ratio of at least about 20%) ensures that the projectile stings, but does not cut the target. The space between walls can be empty or filled. Preferred is a filling of a low density foam material.

When the ring air foil projectile is launched from an adapter 11 attached to a weapon, e.g. a rifle, propulsion forces cause the sabot 15 to separate from adapter 11, then ring air foil 1 separates from sabot 15 and continues in its relatively flat trajectory. Sabot 15 is fabricated from a light-weight rigid (foam) material with a plurality of fingers 16 formed therein. Fingers 16 are torn away from base 17 of sabot 15 at undercut 18 in flight by centrifugal force to permit projectile 1 to separate in flight from sabot 15. Adapter 11 will normally be designed to impart the desired spin rate of projectile 1. The base 17 of the sabot may be retained in the launcher or even form an integral part of the launch device. This leaves only the fingers and the projectile to be ejected. The separated sabot fingers 16 slow rapidly, and drop to the ground almost immediately. Other adapter designs may be employed which do not release the sabot but retain it at the muzzle of the adapter so that no sabot pieces are ejected, and the sabot may be reused for releasing another projectile.

Desirably the projectile wall is thickened and shaped to form a shoulder 12 at the point of intersection of inner wall 2 and outer wall 3 with enough weight of material to act as ballast for center of gravity control for the ring air foil. Alternatively, the projectile structure can be all foam plastic with denser non-foam plastic inserts to act as ballast for center of gravity control.

Figure 6:
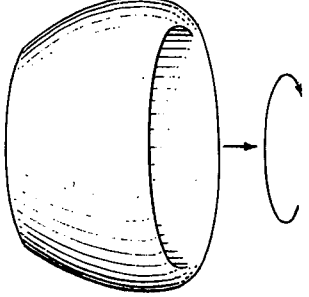
FIG. 6 is a view of the projectile mode of FIG. 4 showing the completed projectile and the projectile in the direction of flight and the sense of rotation in flight.

In flight, projectile 1 flies in an attitude with rounded edge portion 4 leading, feathered edge portion 5 trailing, and the projectile rotating in a clockwise direction, as shown in FIG. 6. As has already been pointed out, the smooth low drag airfoil shaping minimizes velocity decay and spin decay of the projectile in flight, conserving the launch imparted kinetic energy and centrifugal forces. Thus, impact at short or nominal ranges e.g. point-blank to 50 meters stings and bruises, but should not cause serious injuries.

What is claimed:

1. A non-lethal, non-fragmenting, kinetic energy type rotatable projectile comprising: an annular ring shaped, closed structure of a tear drop airfoil cross-section; said structure being composed of resilient material and defined externally by major annular inner and outer surfaces defining the diametric extent of said structure, and being terminated by leading and trailing edges defining the longitudinal extent of said structure; said structure defining an internal annular hollow portion which is occupied by a second unified material.

2. The projectile of claim 1 wherein said second material is a foam material.

3. The projectile of claim 2 wherein said material serves as a ballast.

4. The invention of claim 1 wherein said resilient material is molded foam.

5. The invention of claim 4 wherein said hollow portion is occupied by a second foam material.

6. The invention of claim 5 wherein the density and location of said second foam material and the density of the structure are variable to produce the desired peak impact energy and total impact energy in order to have maximum impact effectiveness without being lethal.

7. The invention of claim 1 wherein the diametric extent exceeds 2 inches so that permanent injury to the human target will be minimized.

* * * * *